US007697665B2

(12) United States Patent
Yonezawa et al.

(10) Patent No.: US 7,697,665 B2
(45) Date of Patent: Apr. 13, 2010

(54) ROTATING ANODE X-RAY TUBE

(75) Inventors: Tetsuya Yonezawa, Yaita (JP); Hironori Nakamuta, Otawara (JP); Ryoichi Takahashi, Yokosuka (JP); Yasuo Yoshii, Kawasaki (JP); Hitoshi Hattori, Yokohama (JP); Yasutaka Ito, Kawasaki (JP)

(73) Assignees: Kabushiki Kaisha Toshiba, Tokyo (JP); Toshiba Electron Tubes & Devices Co., Ltd., Tochigi-ken (JP)

( * ) Notice: Subject to any disclaimer, the term of this patent is extended or adjusted under 35 U.S.C. 154(b) by 0 days.

(21) Appl. No.: 12/469,254

(22) Filed: May 20, 2009

(65) Prior Publication Data

US 2009/0225950 A1 Sep. 10, 2009

Related U.S. Application Data

(63) Continuation of application No. PCT/JP2007/073390, filed on Dec. 4, 2007.

(30) Foreign Application Priority Data

Dec. 4, 2006 (JP) ..... 2006-327358

(51) Int. Cl.
*H01J 35/00* (2006.01)

(52) U.S. Cl. ..... 378/130; 378/133; 378/144

(58) Field of Classification Search ..... 378/119, 378/121, 125, 127, 130, 132, 133, 144, 200
See application file for complete search history.

(56) References Cited

U.S. PATENT DOCUMENTS 5,541,975 A 7/1996 Anderson et al. ..... 378/130

FOREIGN PATENT DOCUMENTS

| | | |
|---|---|---|
| DE | 3644719 C1 | 3/1988 |
| JP | 63-13302 | 3/1988 |
| JP | 05-144395 | 6/1993 |
| JP | 05-258691 | 10/1993 |
| JP | 08-507647 | 8/1996 |
| JP | 2003-77412 | 3/2003 |
| JP | 2004-349158 | 12/2004 |
| JP | 2006-302648 | 11/2006 |
| WO | WO 2005/038852 | 4/2005 |

*Primary Examiner*—Courtney Thomas
(74) *Attorney, Agent, or Firm*—Pillsbury Winthrop Shaw Pittman, LLP

(57) ABSTRACT

A rotating anode X-ray tube includes a fixed body having a radial sliding bearing surface and a channel therein through which a coolant flows, a rotor including a discoid large-diameter portion, which has a recess fitted with one end portion of the fixed body with a clearance therebetween and constitutes an anode target, and a small-diameter portion, which has on an inner surface thereof a radial sliding bearing surface which faces the aforesaid radial sliding bearing surface with a clearance, and is united with the large-diameter portion at one end portion thereof, a lubricant filling the clearances, a cathode arranged opposite to the anode target, and a vacuum envelope which contains the fixed body, the rotor, the lubricant and the cathode, and fixes the fixed body at another end portion of the fixed body situated opposite the one end portion of the fixed body fitted in the recess.

13 Claims, 10 Drawing Sheets

ROTATING ANODE X-RAY TUBE

CROSS-REFERENCE TO RELATED APPLICATIONS

This is a Continuation Application of PCT Application No. PCT/JP2007/073390, filed Dec. 4, 2007, which was published under PCT Article 21(2) in Japanese.

This application is based upon and claims the benefit of priority from prior Japanese Patent Application No. 2006-327358, filed Dec. 4, 2006, the entire contents of which are incorporated herein by reference.

BACKGROUND OF THE INVENTION

1. Field of the Invention

This invention relates to a rotating anode X-ray tube.

2. Description of the Related Art

In general, X-ray tube assemblies are used in medical diagnostic systems, industrial diagnostic systems, etc. An X-ray tube assembly comprises a rotating anode X-ray tube that emits X-rays, a stator coil, and a housing that contains the rotating anode X-ray tube and the stator coil. The rotating anode X-ray tube includes a fixed shaft, a rotor provided for rotation around the fixed shaft as an axis, an anode target disposed on an end portion of the rotor via a joint portion, a cathode arranged opposite to the anode target, a vacuum envelope that contains these elements, and a coolant that fills the vacuum envelope. A clearance between the fixed shaft and the rotor is filled with a liquid metal.

In an operating state of the X-ray tube assembly, the stator coil generates a magnetic field to be applied to the rotor, so that the rotor and the anode target rotate. Further, the cathode emits an electron beam to the anode target. Thereupon, the anode target radiates X-rays as it is struck by electrons.

During the operation of the X-ray tube assembly, the anode target is heated to high temperature by heat input to the anode target. Specifically, the anode target is heated to high temperature when it is irradiated with the electron beam. In particular, an electron impact surface (focus) that is struck by the electrons is heated to high temperature. Accordingly, the temperature of the electron impact surface must be lower than the melting temperature of the material of the anode target.

To meet this requirement, a technique for cooling the anode target has been developed. For example, a technique for cooling an anode target by using a liquid metal as a heat transfer fluid near an electron impact surface is disclosed in U.S. Pat. No. 5,541,975 and DE644719. Use of this technique enables high cooling of the anode target.

In the disclosed technique described above, however, a seal portion for the liquid metal is formed near the electron impact surface. Since heat generated from the electron impact surface is transmitted to the seal portion, the seal portion is inevitably heated to high temperature and deformed. Since a clearance between a rotor and a fixed shaft is deformed, it is difficult to maintain a clearance for the sealing performance of the seal portion to be fully displayed. In consequence, the X-ray tube may possibly be rendered defective by a leakage of the liquid metal.

Techniques for preventing the seal portion for the liquid metal from being heated to high temperature is disclosed in, for example, Jpn. Pat. Appln. KOKOKU Publication No. 63-13302, Jpn. Pat. Appln. KOKAI Publication No. 5-258691, and Jpn. Pat. Appln. KOKAI Publication No. 5-144395.

BRIEF SUMMARY OF THE INVENTION

As described above, there is disclosed a technique that enables high cooling of the anode target and a technique for preventing the seal portion for the liquid metal from being heated to high temperature. However, no technique is disclosed that enables high cooling of the anode target and can prevent the seal portion from being heated to high temperature.

This invention has been made in consideration of these circumstances, and its object is to provide a rotating anode X-ray tube of which an anode target has a high enough cooling rate to prolong the product life.

In order to solve the above problem, according to an aspect of the present invention there is provided a rotating anode X-ray tube comprising:

a fixed body having a radial sliding bearing surface on a side surface thereof and a channel therein through which a coolant flows;

a rotor including a discoid large-diameter portion, which has a recess fitted with one end portion of the fixed body with a clearance therebetween and constitutes an anode target, and a small-diameter portion, which surrounds the side surface of the fixed body, has on an inner surface thereof a radial sliding bearing surface which faces the aforesaid radial sliding bearing surface with a clearance, and is united with the large-diameter portion at one end portion thereof;

a lubricant filling the clearances;

a cathode arranged opposite to the anode target of the large-diameter portion; and a vacuum envelope which contains the fixed body, the rotor, the lubricant and the cathode, and fixes the fixed body at another end portion of the fixed body situated opposite the one end portion of the fixed body fitted in the recess.

DETAILED DESCRIPTION OF THE INVENTION

A rotating anode X-ray tube assembly according to a first embodiment of this invention will now be described with reference to the drawings.

Figure 1:
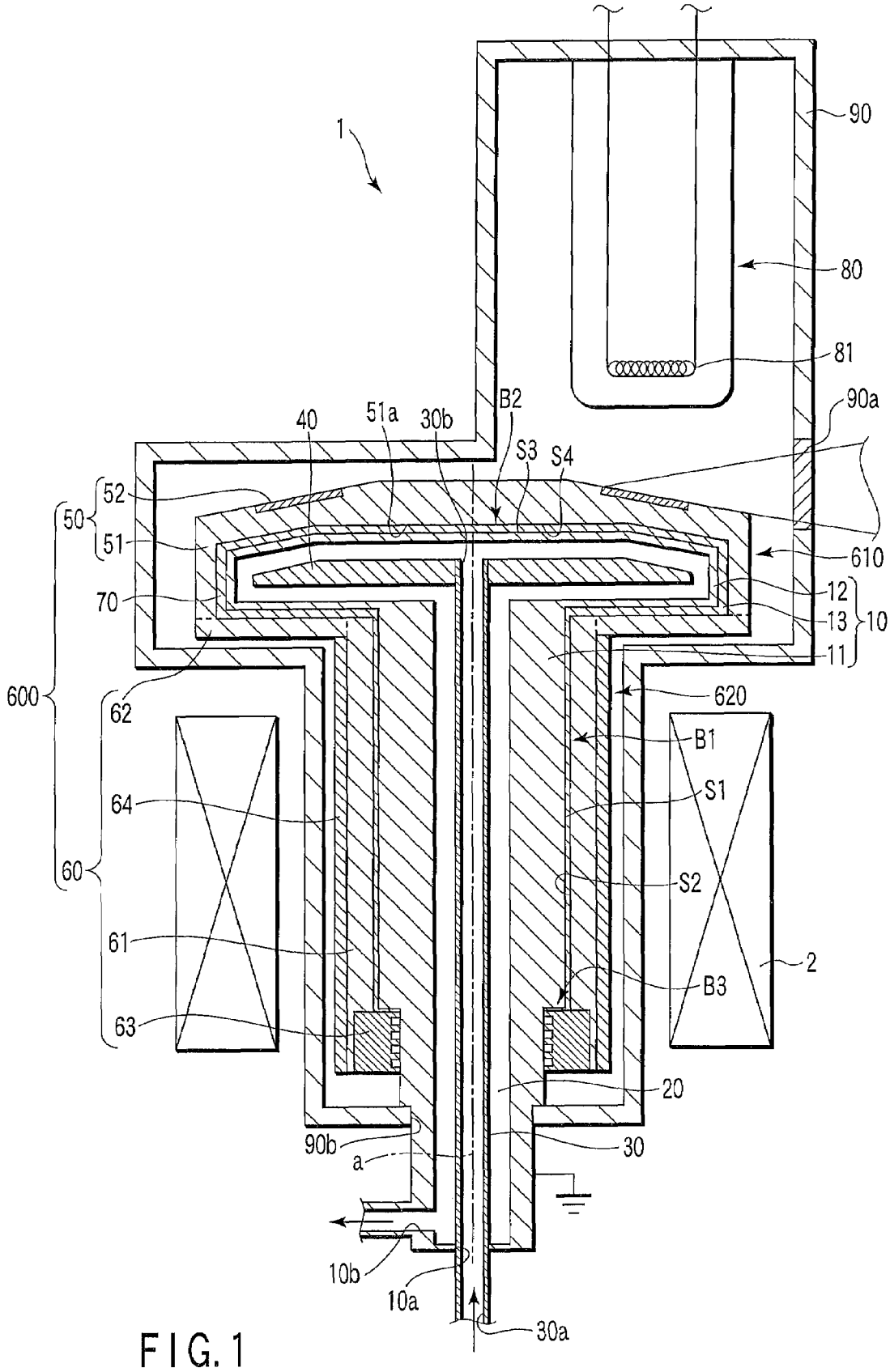
FIG. 1 is a sectional view showing a rotating anode X-ray tube assembly according to a first embodiment of this invention.

As shown in FIG. 1, the rotating anode X-ray tube assembly comprises a rotating anode X-ray tube 1, a stator coil 2 for use as a coil that generates a magnetic field, and a housing (not shown) that contains the rotating anode X-ray tube and the stator coil.

The rotating anode X-ray tube 1 comprises a fixed shaft 10 as a fixed body, coolant 20, pipe portion 30, annular portion 40, anode target 50, rotating portion 60, liquid metal 70 as a lubricant, cathode 80, and vacuum envelope 90. The rotating anode X-ray tube 1 uses a dynamic-pressure bearing.

The fixed shaft 10 includes a barrel portion 11, a barrel portion 12 as another barrel portion, and an annular portion 13. The fixed shaft 10 is formed of a material such as Fe (iron) or Mo (molybdenum). The barrel portion 11 extends along a rotation axis a and is formed to be cylindrical around the rotation axis a as its central axis. The barrel portion 11 has a radial sliding bearing surface S1 on its side surface. The barrel portion 12 extends along the rotation axis a and is formed to be cylindrical around the rotation axis a as its central axis. One end portion of the barrel portion 12 is closed. The other end portion the barrel portion 12 closely communicates with the barrel portion 11. More specifically, the annular portion 13 is closely joined to the barrel portions 11 and 12 so that the barrel portions 11 and 12 communicate with each other. The barrel portions 11 and 12 and the annular portion 13 are formed integrally with one another. The interior of the fixed shaft 10 is filled with the coolant 20. The coolant 20 is water in this embodiment. The fixed shaft 10 defines therein a channel through which the coolant 20 flows. The fixed shaft 10 has a discharge port 10*b* on its other end side through which the coolant 20 is discharged to the outside.

The pipe portion 30 is disposed inside the fixed shaft 10 and defines a channel in conjunction with the fixed shaft. One end portion of the pipe portion 30 extends to the outside of the fixed shaft 10 through an opening 10*a* formed in the other end portion of the fixed shaft 10. The pipe portion 30 is fixed to the opening 10*a*. The side surface of the pipe portion 30 is in close contact with the opening 10*a*.

The pipe portion 30 has an intake port 30*a* through which the coolant 20 is introduced into the pipe portion 30, and a discharge port 30*b* through which the coolant 20 is discharged into the fixed shaft 10. The intake port 30*a* is situated outside the fixed shaft 10. The discharge port 30*b* is situated at one end portion of the fixed shaft 10 with a gap therebetween.

The annular portion 40 is disposed inside the barrel portion 12 and formed integrally with the pipe portion 30 so as to surround the side surface of the pipe portion 30. The annular portion 40 is disposed inside the barrel portion 12 with a gap therebetween. The pipe portion 30 and the annular portion 40, along with the fixed shaft 10, define a channel.

Thus, the coolant 20 from outside the rotating anode X-ray tube 1 is introduced through the intake port 30*a* and discharged through the interior of the pipe portion 30 into the barrel portion 12. The coolant 20 passes between the barrel portion 12 and the annular portion 40, between the annular portion 13 and the annular portion 40, and between the barrel portion 11 and the pipe portion 30, and is discharged through the discharge port 10*b* to the outside of the rotating anode X-ray tube 1.

The anode target 50 includes an anode 51 and a target layer 52 provided on a part of the outer surface of the anode. The anode 51 is formed to be discoid and provided coaxially with the fixed shaft 10. The anode 51 is formed of a material such as Mo. The anode 51 has a recess 51*a* that is recessed along the rotation axis a. The recess 51*a* has a shape of a disc. The barrel portion 12 is fitted in the recess 51*a*. The recess 51*a* is formed in the barrel portion 12 with a gap therebetween. In the direction along the rotation axis a, the recess 51*a* overlaps the entire target layer 52. A heat transfer channel of the liquid metal 70 is disposed just under (or inside) the target layer 52. The target layer 52 is formed to be a ring of W (tungsten) or other material. A surface of the target layer 52 is an electron impact surface.

The barrel portion 12 has a thrust bearing surface S3. The anode 51 has a thrust bearing surface S4. The bearing surface S3 and the bearing surface S4 are opposed to each other with a gap along the rotation axis a. The bearing surface S3 and the bearing surface S4 form a thrust bearing B2.

The barrel-shaped rotating portion 60 is formed to be larger in diameter than the barrel portion 11. The rotating portion 60 is coaxial with the fixed shaft 10 and the anode target 50. The rotating portion 60 is formed to be shorter than the barrel portion 11.

The rotating portion 60 is formed of a material such as Fe or Mo. More specifically, the rotating portion 60 includes a barrel portion 61, an annular portion 62 formed integrally with the barrel portion 61 so as to surround the side surface of the barrel portion at one end portion thereof, a seal portion 63 provided at another end potion of the barrel potion 61, and a barrel portion 64.

The barrel portion 61 surrounds the side surface of the barrel portion 11. The barrel portion 61 has a radial sliding bearing surface S2 on its inner surface that is opposed to the bearing surface S1 with a gap. The bearing surface S1 and the bearing surface S2 form a radial sliding bearing B1. The bearing surface S1 and the bearing surface S2 are each provided with a groove. The annular portion 62 of the rotating portion 60 is joined to the anode target 50. The rotating portion 60 is rotatable together with the anode target 50 around the fixed shaft 10 as its axis.

The seal portion 63 is situated on the opposite side of the bearing surface S2 from the annular portion 62 (one end portion). The seal portion 63 is joined to the another end portion of the barrel portion 61. The seal portion 63 is formed to be annular and disposed covering the entire circumference of the side surface of the fixed shaft 10 with a gap therebetween. The barrel portion 64 is joined to the side surface of the barrel portion 61 and fixed to the barrel portion 61. The barrel portion 64 is formed of, for example, Cu (copper).

The liquid metal 70 fills a clearance between the barrel portion 12 and the recess 51*a*, a clearance between the annular portion 13 and the annular portion 62, a clearance between the annular portion 13 and the barrel portion 61, and a clearance between the barrel portion 11 (bearing surface S1) and the barrel portion 61 (bearing surface S2). All these clearances are connected together. In this embodiment, the liquid metal 70 is a gallium-indium-tin (GAInSn) alloy.

Figure 2:
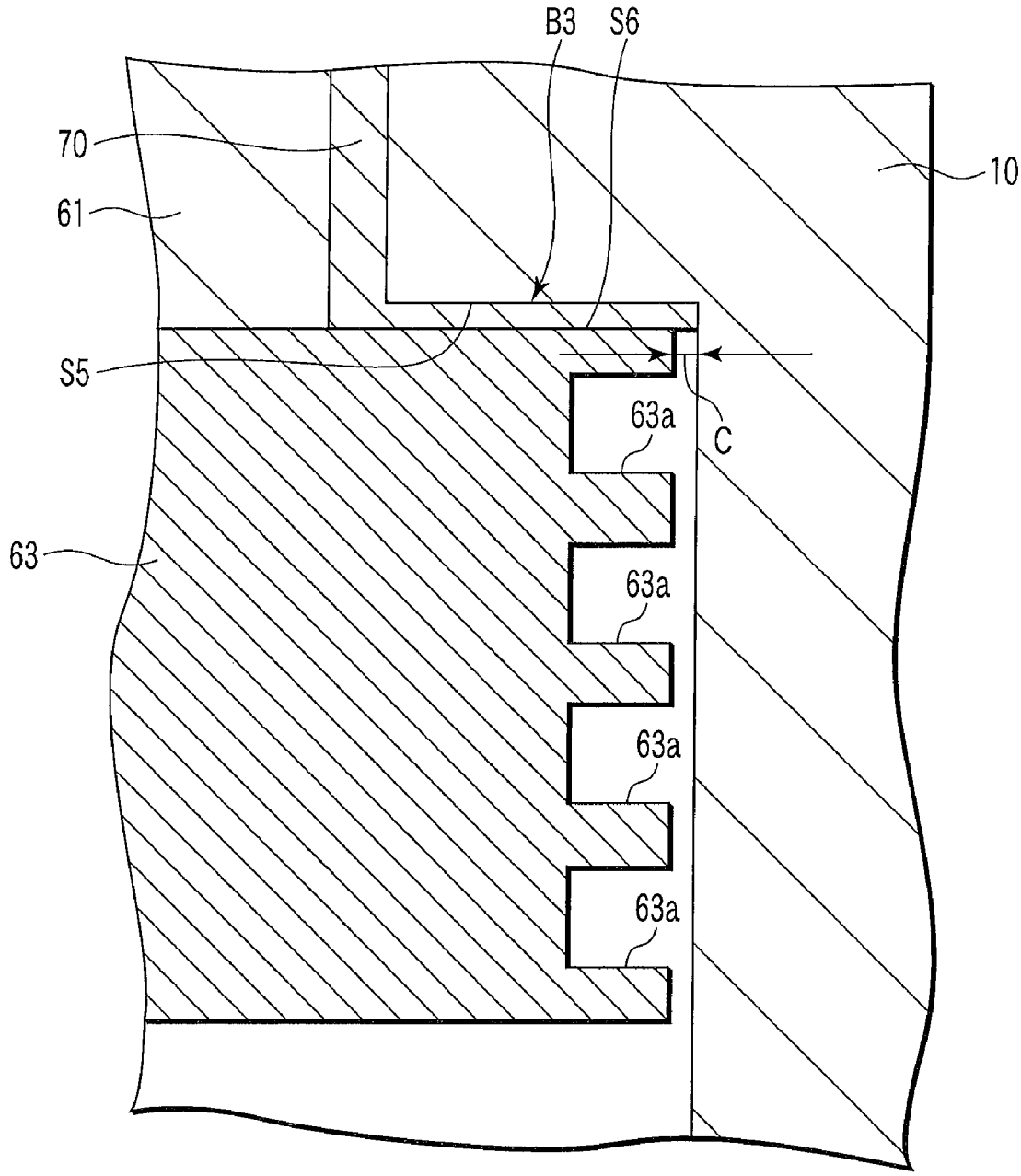
FIG. 2 is an enlarged sectional view showing a part of the rotating anode X-ray tube assembly shown in FIG. 1, especially a seal portion.

As shown in FIGS. 1 and 2, a gap (clearance) c between the seal portion 63 and the fixed shaft 10 is set to such a value that the rotation of the rotating portion 60 can be maintained and a leakage of the liquid metal 70 can be suppressed. Therefore, the clearance c is small. The width of the clearance c is 500

μm or less in this embodiment. Thus, the seal portion 63 functions as a labyrinth seal ring.

Further, the seal portion 63 includes a plurality of storage portions 63*a*. In this case, the seal portion 63 includes four storage portions 63*a*. Each of the storage portions 63*a* is formed by depressing the inside of the seal portion 63 to have a circular shape. The storage portions 63*a* receive the liquid metal 70 if the liquid metal 70 leaks out through the clearance c.

The barrel portion 11 has a thrust bearing surface S5. The seal portion 63 has a thrust bearing surface S6. The bearing surface S5 and the bearing surface S6 are opposed to each other with a gap along the rotation axis a. The bearing surface S5 and the bearing surface S6 form a thrust bearing B3. This thrust bearing B3 cannot be heated to high temperature, so that the clearance between the bearing surface S5 and the bearing surface S6 can be kept constant. Even if the target is heated to high temperature, therefore, the thrust bearing B3 can function normally.

The anode target 50 and the rotating portion 60 described above form a rotor 600. The rotor 600 is integrally formed of the anode target 50 and the rotating portion 60. The rotor 600 includes a large-diameter portion 610 and a small-diameter portion 620 that is smaller in diameter than the large-diameter portion 610. In this embodiment, the large-diameter portion 610 is the anode target 50, and the small-diameter portion 620 is the rotating portion 60.

As shown in FIG. 1, the cathode 80 is arranged opposite to the target layer 52 of the anode target 50 in spaced relation. The cathode 80 includes a filament 81 that emits electrons.

The vacuum envelope 90 contains therein the fixed shaft 10, coolant 20, pipe portion 30, annular portion 40, anode target 50, rotating portion 60, liquid metal 70, and cathode 80. The vacuum envelope 90 has an X-ray transmission window 90*a* and an opening 90*b*. The X-ray transmission window 90*a* is opposed to the target layer 52 at right angles to the rotation axis a. The another end portion of the fixed shaft 10 is exposed to the outside of the vacuum envelope 90 through the opening 90*b*. The opening 90*b* fixes the fixed shaft 10. The side surface of the fixed shaft 10 is in close contact with the opening 90*b*.

The cathode 80 is attached to the inner wall of the vacuum envelope 90. The vacuum envelope 90 is sealed. The interior of the vacuum envelope 90 is kept in a vacuum state.

The stator coil 2 is disposed so as to face the side surface of the rotating portion 60, and more specifically, to the side surface of the barrel portion 64, and surround the outside of the vacuum envelope 90. The shape of the stator coil 2 is annular.

Besides containing the rotating anode X-ray tube 1 and the stator coil 2, the housing is filled with a coolant (not shown).

In an operating state of the X-ray tube assembly, the stator coil 2 generates a magnetic field to be applied to the rotating portion 60 (barrel portion 64 in particular), so that the rotor 600 rotates. Thereupon, the anode target 50 rotates. Further, a relatively negative voltage is applied to the cathode 80, and a relatively positive voltage is applied to the anode target 50. For example, a voltage of −150 kV is applied to the cathode 80, while the anode target 50 is grounded.

Thus, a potential difference is caused between the cathode 80 and the anode target 50. If the cathode 80 emits electrons, therefore, the electrons are accelerated and caused to collide with the target layer 52. Specifically, the cathode 80 emits an electron beam to the target layer 52. Thereupon, the target layer 52 radiates X-rays as it is struck by the electrons, and the radiated X-rays are discharged to the outside of the vacuum envelope 90 or housing through the X-ray transmission window 90*a*.

According to the rotating anode X-ray tube device constructed in this manner, the anode target 50 includes the recess 51*a* that overlaps the target layer 52, and the fixed shaft 10 is fitted in the recess 51*a*. The target layer 52 and the channel for the coolant 20 are situated close to each other.

As the X-rays are radiated, due to generation of the centrifugal force of the rotating rotor 600, the liquid metal 70 flows to a region just below the target layer 52 (orbital plane of the focus of the anode target 50) and fills there, thereby forming a layer of the liquid metal 70. When the X-rays are radiated, the anode target 50, especially the electron impact surface of the target layer 52, is heated to a high temperature. Heat from the target layer 52 transmitted to the fixed shaft 10 through the anode 51 and the liquid metal 70 and radiated to the coolant 20 that flows through the channel inside the fixed shaft 10. When this is done, the liquid metal 70 functions as a heat transfer fluid. A heat conduction path from the target layer 52 to the channel for the coolant 20 is short. Accordingly, there can be obtained the rotating anode X-ray tube 1 of which the anode target 50 is further improved in cooling rate.

Thus, malfunctioning of the anode target 50, such as melting of the anode target 50, can be suppressed. Since an allowable heat input for the anode target 50 can be increased, the output of the rotating anode X-ray tube 1 can be improved. In addition, an effect to prolong the product life of the rotating anode X-ray tube 1 can be obtained.

Further, the use of water for the coolant 20 contributes to a higher output of the rotating anode X-ray tube 1 as well as to an improvement in the cooling rate of the anode target 50. Specifically, the coolant 20 is boiled at the electric heating interface and assists in heating. Thus, boiling-cooling is higher in cooling efficiency than cooling that involves no boiling and can further lower the temperature of the target layer 52. In consequence, the anode target 50 can be cooled with a high efficiency.

The seal portion 63 is situated on the opposite side of the bearing surface S2 from the annular portion 62 (one end portion). The seal portion 63 is not disposed near the electron impact surface of the target layer 52. Since the seal portion 63 is kept at a distance from the electron impact surface on the heat path, it cannot be influenced by the heat that is produced by electron impact. Specifically, deformation of the seal portion 63 by heating of the seal portion 63 to a high temperature can be suppressed. Thus, the clearance c can be reduced without taking thermal deformation of the seal portion 63 into consideration, and leakage of the liquid metal 70 from the seal portion 63 can be suppressed.

If the liquid metal 70 splashes as it moves in the clearance near the large-diameter portion 610 when the rotor 600 is shifted from the stationary state to the rotating state, for example, the seal portion 63 cannot be adversely affected by such splashes. Thus, the seal portion 63 cannot be wetted by the liquid metal 70, and the liquid metal 70 can be prevented from leaking into a vacuum space.

If a ball bearing that uses a solid lubricant is adopted for the rotating anode X-ray tube 1, the liquid metal may possibly flow into the ball bearing and remain in and adhere to it, thereby preventing plastic flow of the solid lubricant. However, the rotating anode X-ray tube 1 uses the dynamic-pressure bearing in which the liquid metal 70 itself serves as a lubricant. Accordingly, the lubrication performance cannot be reduced, so that the anode target 50 can be stably rotated for a long period of time, and hence, the effect to prolong the product life of the rotating anode X-ray tube 1 can be obtained.

Thus, there can be obtained the rotating anode X-ray tube 1 of which the anode target 50 has a high enough cooling rate to prolong the product life and the rotating anode X-ray tube assembly provided with the rotating anode X-ray tube 1.

The following is a detailed description of a rotating anode X-ray tube assembly according to a second embodiment of this invention. Other configurations in this embodiment are the same as those in the first embodiment described above, so that like numbers are used to designate like portions, and a detailed description thereof is omitted.

Figure 3:
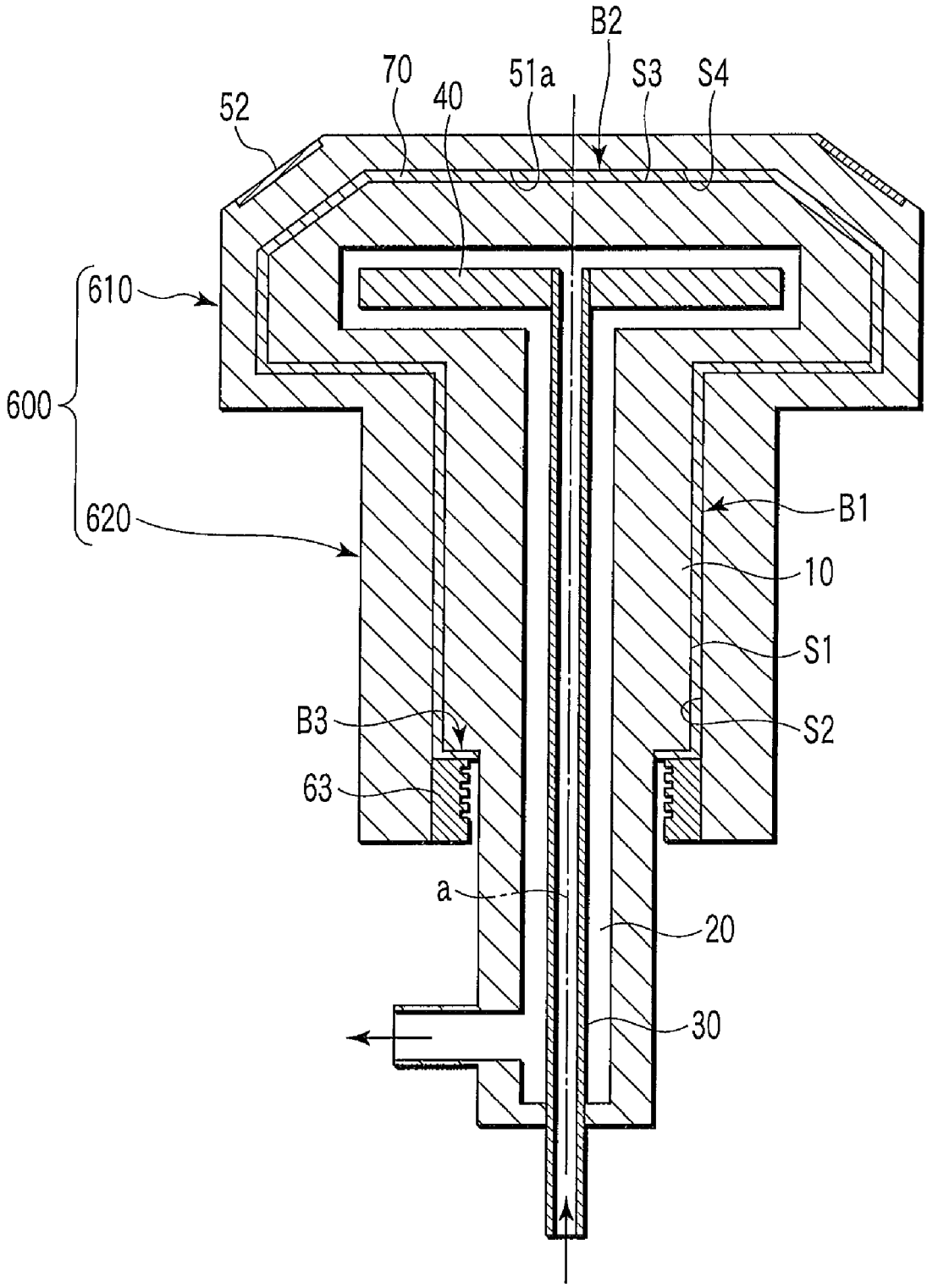
FIG. 3 is a sectional view showing a principal part of a rotating anode X-ray tube assembly according to a second embodiment of this invention.

As shown in FIG. 3, a rotor 600 includes a large-diameter portion 610 and a small-diameter portion 620. The large-diameter portion 610 and the small-diameter portion 620 are formed integrally with each other without joint surfaces. A recess 51*a* overlaps an entire target layer 52. A heat transfer channel of a liquid metal 70 is disposed just under (or inside) the target layer 52.

According to the rotating anode X-ray tube assembly constructed in this manner, an anode target 50 includes the recess 51*a* that overlaps the target layer 52, and a fixed shaft 10 is fitted in the recess 51*a*. The target layer 52 and a channel for the coolant 20 are situated close to each other. Thus, a heat conduction path from the target layer 52 to the channel for the coolant 20 is short.

Accordingly, there can be obtained a rotating anode X-ray tube 1 of which the anode target 50 has a high enough cooling rate to prolong the product life and the rotating anode X-ray tube assembly provided with the rotating anode X-ray tube 1.

The following is a detailed description of a rotating anode X-ray tube assembly according to a third embodiment of this invention. Other configurations in this embodiment are the same as those in the first embodiment described above, so that like numbers are used to designate like portions, and a detailed description thereof is omitted.

Figure 4:
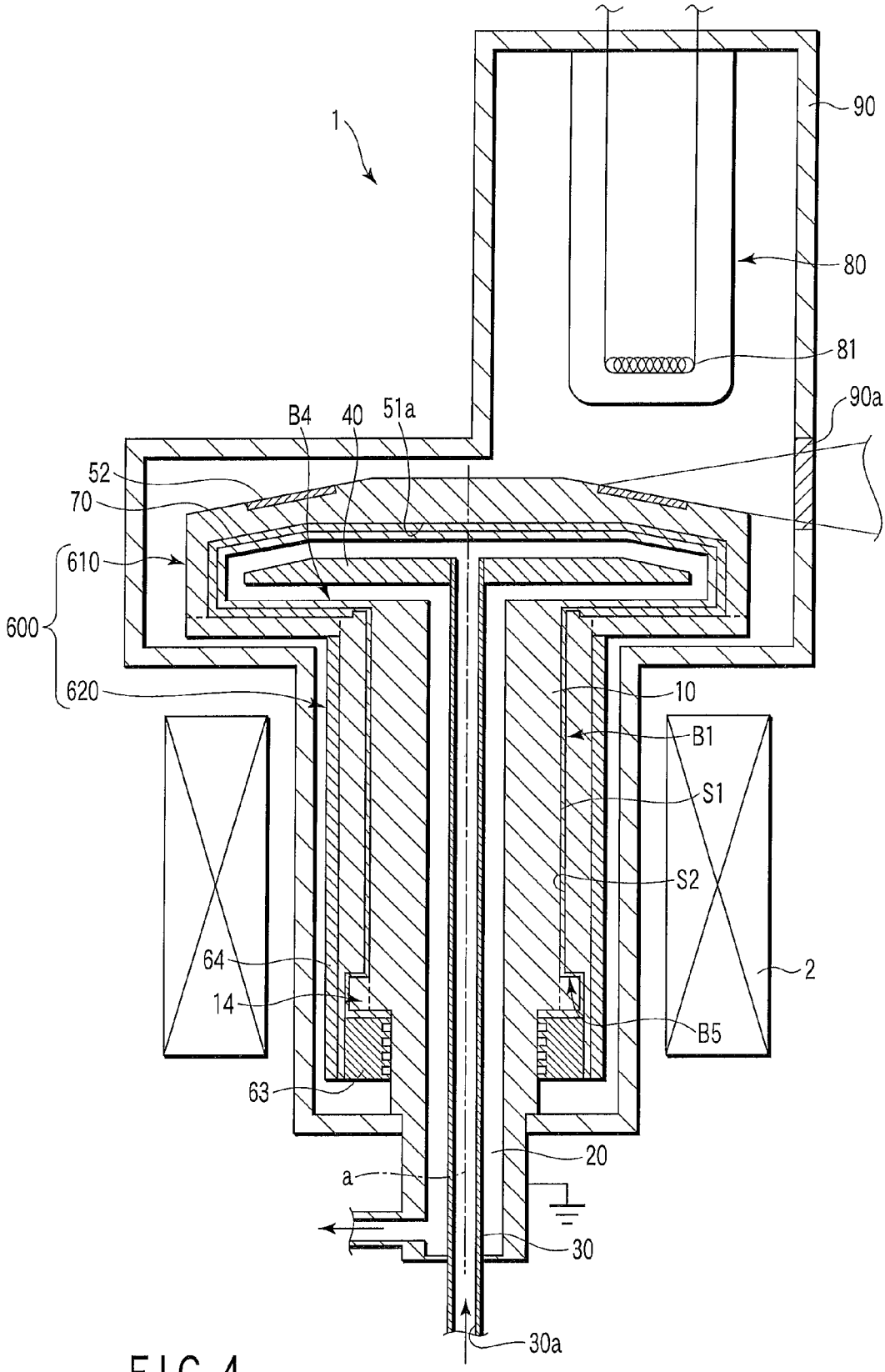
FIG. 4 is a sectional view showing a rotating anode X-ray tube assembly according to a third embodiment of this invention.
Figure 5:
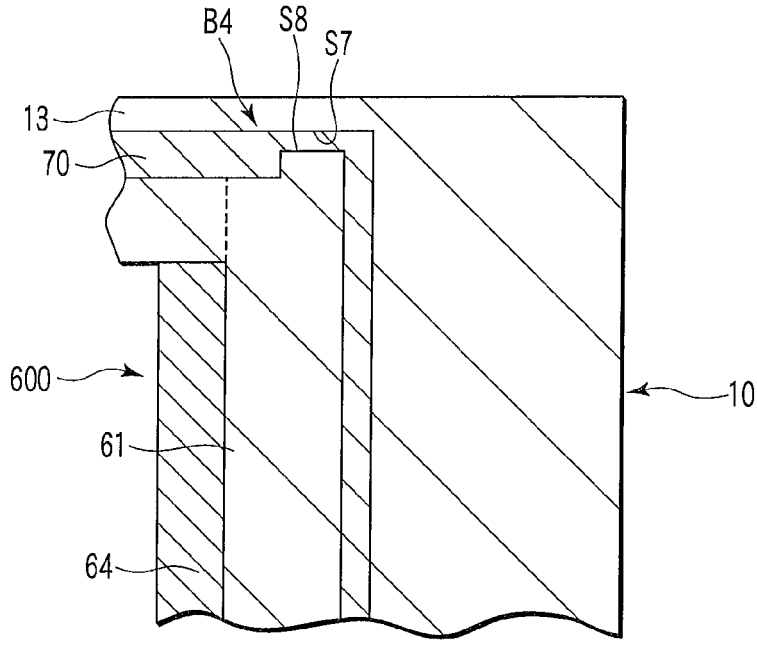
FIG. 5 is an enlarged sectional view showing a part of the rotating anode X-ray tube assembly shown in FIG. 4, especially a thrust bearing.

As shown in FIGS. 4 and 5, a rotor 600 (barrel portion 61) has a thrust bearing surface S8 near the boundary between a large-diameter portion 610 and a small-diameter portion 620. A fixed shaft 10 (annular portion 13) has a thrust bearing surface S7. The thrust bearing surface S7 and the thrust bearing surface S8 are opposed to each other with a gap along a rotation axis a. The bearing surface S7 and the bearing surface S8 form a thrust bearing B4.

Since this thrust bearing B4 is not heated to a high temperature, the clearance between the bearing surface S7 and the bearing surface S8 can be kept constant. Even if the target is heated to a high temperature, therefore, the thrust bearing B4 can function normally.

Figure 6:
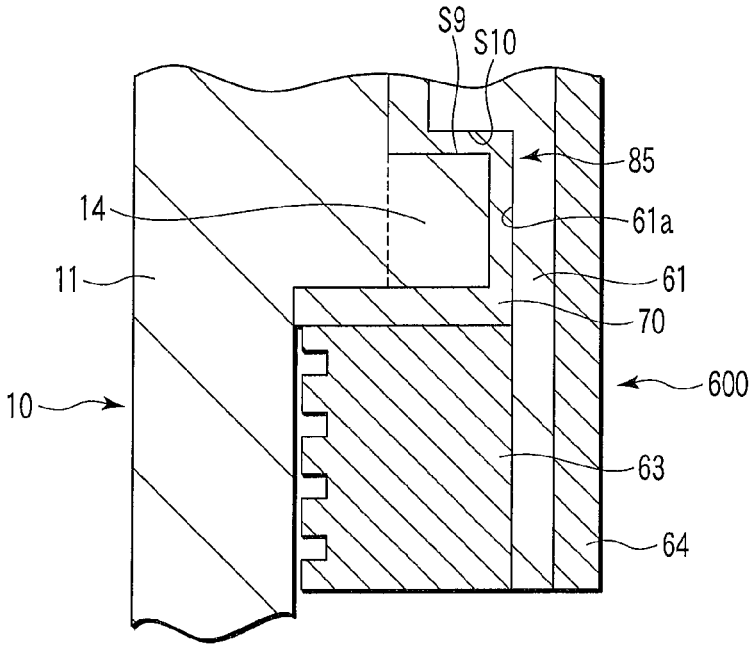
FIG. 6 is an enlarged sectional view showing a part of the rotating anode X-ray tube assembly shown in FIG. 4, especially another thrust bearing.

As shown in FIGS. 4 and 6, the fixed shaft 10 further includes an annular portion 14. The annular portion 14 surrounds the side surface of a barrel portion 11 on the opposite side of a radial sliding bearing surface S1 from a barrel portion 12 (large-diameter portion 610). The barrel portion 11 and the annular portion 14 are formed integrally with each other without joint surfaces.

The barrel portion 61 includes a stepped portion 61*a* with a depressed inner surface on the opposite side of a radial sliding bearing surface S2 from the large-diameter portion 610. The annular portion 14 is fitted in a space that is surrounded by the stepped portion 61*a* and a seal portion 63.

The annular portion 14 has a thrust bearing surface S9. The barrel portion 61 has a thrust bearing surface S10. The bearing surface S9 and the bearing surface S10 are opposed to each other with a gap along the rotation axis a. The bearing surface S9 and the bearing surface S10 form a thrust bearing B5. Since the thrust bearing B5 is not heated to a high temperature, the clearance between the bearing surface S9 and the bearing surface S10 can be kept constant. Even if the target is heated to a high temperature, therefore, the thrust bearing B5 can function normally.

According to the rotating anode X-ray tube assembly constructed in this manner, an anode target 50 includes a recess 51*a* that overlaps a target layer 52, and the fixed shaft 10 is fitted in the recess 51*a*. The target layer 52 and a channel for the coolant 20 are situated close to each other. Thus, a heat conduction path from the target layer 52 to the channel for the coolant 20 is short.

Since the thrust bearings B4 and B5 are not heated to high temperatures, the thrust bearings B4 and B5 can be prevented from being deformed by heat conduction from the target layer 52. Therefore, the clearance between the thrust bearings B4 and B5 can be kept constant to retain the functions of the thrust bearings B4 and B5, so that a rotation operation of the rotor 600 can be maintained.

Accordingly, there can be obtained a rotating anode X-ray tube 1 of which the anode target 50 has a high enough cooling rate to prolong the product life and the rotating anode X-ray tube assembly provided with the rotating anode X-ray tube 1.

The following is a detailed description of a rotating anode X-ray tube assembly according to a fourth embodiment of this invention. Other configurations in this embodiment are the same as those in the first and third embodiments described above, so that like numbers are used to designate like portions, and a detailed description thereof is omitted.

Figure 7:
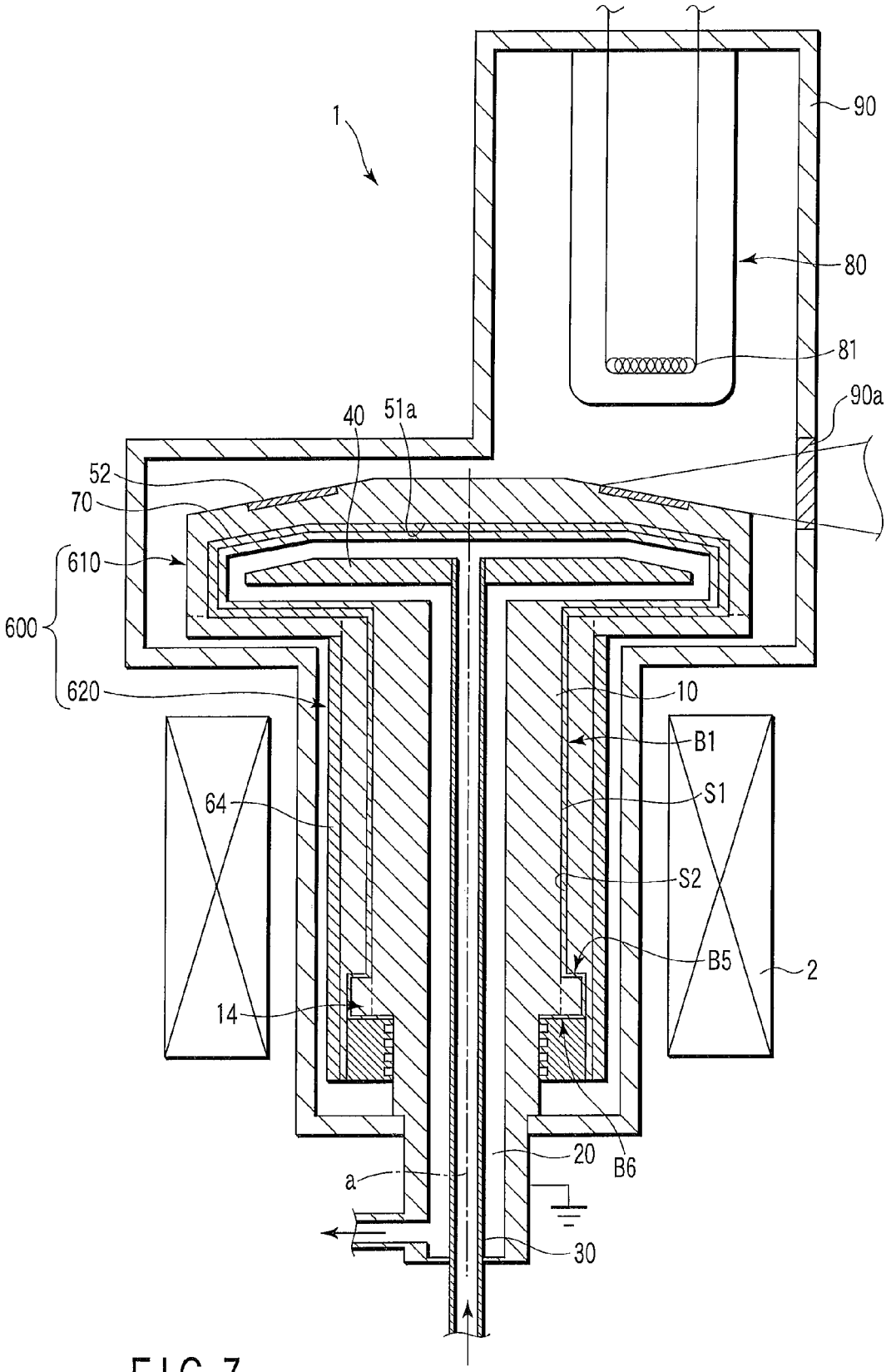
FIG. 7 is a sectional view showing a rotating anode X-ray tube assembly according to a fourth embodiment of this invention.
Figure 8:
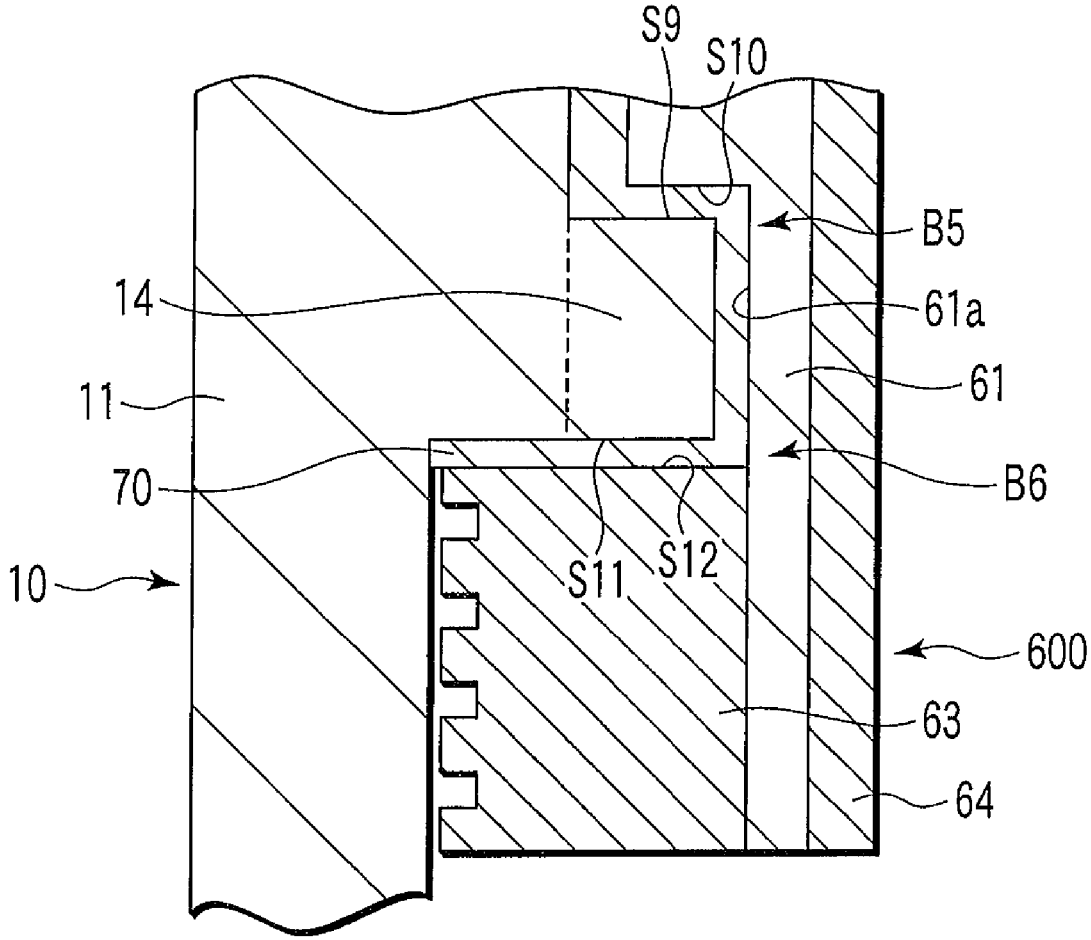
FIG. 8 is an enlarged sectional view showing a part of the rotating anode X-ray tube assembly shown in FIG. 7, especially two thrust bearings.

As shown in FIGS. 7 and 8, a fixed shaft 10 further includes an annular portion 14. A barrel portion 61 includes a stepped portion 61*a*. The annular portion 14 is fitted in a space that is surrounded by the stepped portion 61*a* and a seal portion 63.

The annular portion 14 has a thrust bearing surface S9. The barrel portion 61 has a thrust bearing surface S10. The bearing surface S9 and the bearing surface S10 are opposed to each other with a gap along a rotation axis a. The bearing surface S9 and the bearing surface S10 form a thrust bearing B5.

The annular portion 14 has a thrust bearing surface S11. The seal portion 63 has a thrust bearing surface S12. The bearing surface S11 and the bearing surface S12 are opposed to each other with a gap along the rotation axis a. The bearing surface S11 and the bearing surface S12 form a thrust bearing B6.

Since these thrust bearings B5 and B6 are not heated to high temperatures, the clearance between the bearing surface S9 and the bearing surface S10 and the clearance between the bearing surface S11 and the bearing surface S12 can be kept constant. Even if the target is heated to a high temperature, therefore, the thrust bearing B5 can function normally.

According to the rotating anode X-ray tube device constructed in this manner, an anode target 50 includes a recess 51*a* that overlaps a target layer 52, and the fixed shaft 10 is fitted in the recess 51*a*. The target layer 52 and a channel for the coolant 20 are situated close to each other. Thus, a heat conduction path from the target layer 52 to the channel for the coolant 20 is short.

Since the thrust bearings B5 and B6 are not heated to a high temperature, the thrust bearings B5 and B6 can be prevented from being deformed by heat conduction from the target layer 52. Therefore, the clearance of the thrust bearings B5 and B6 can be kept constant to retain the functions of the thrust bearings B5 and B6, so that a rotation operation of a rotor 600 can be maintained.

Accordingly, there can be obtained a rotating anode X-ray tube 1 of which the anode target 50 has a high enough cooling rate to prolong the product life and the rotating anode X-ray tube assembly provided with the rotating anode X-ray tube 1.

The following is a detailed description of a rotating anode X-ray tube device according to a fifth embodiment of this invention. Other configurations in this embodiment are the same as those in the first and fourth embodiments described above, so that like numbers are used to designate like portions, and a detailed description thereof is omitted.

Figure 9:
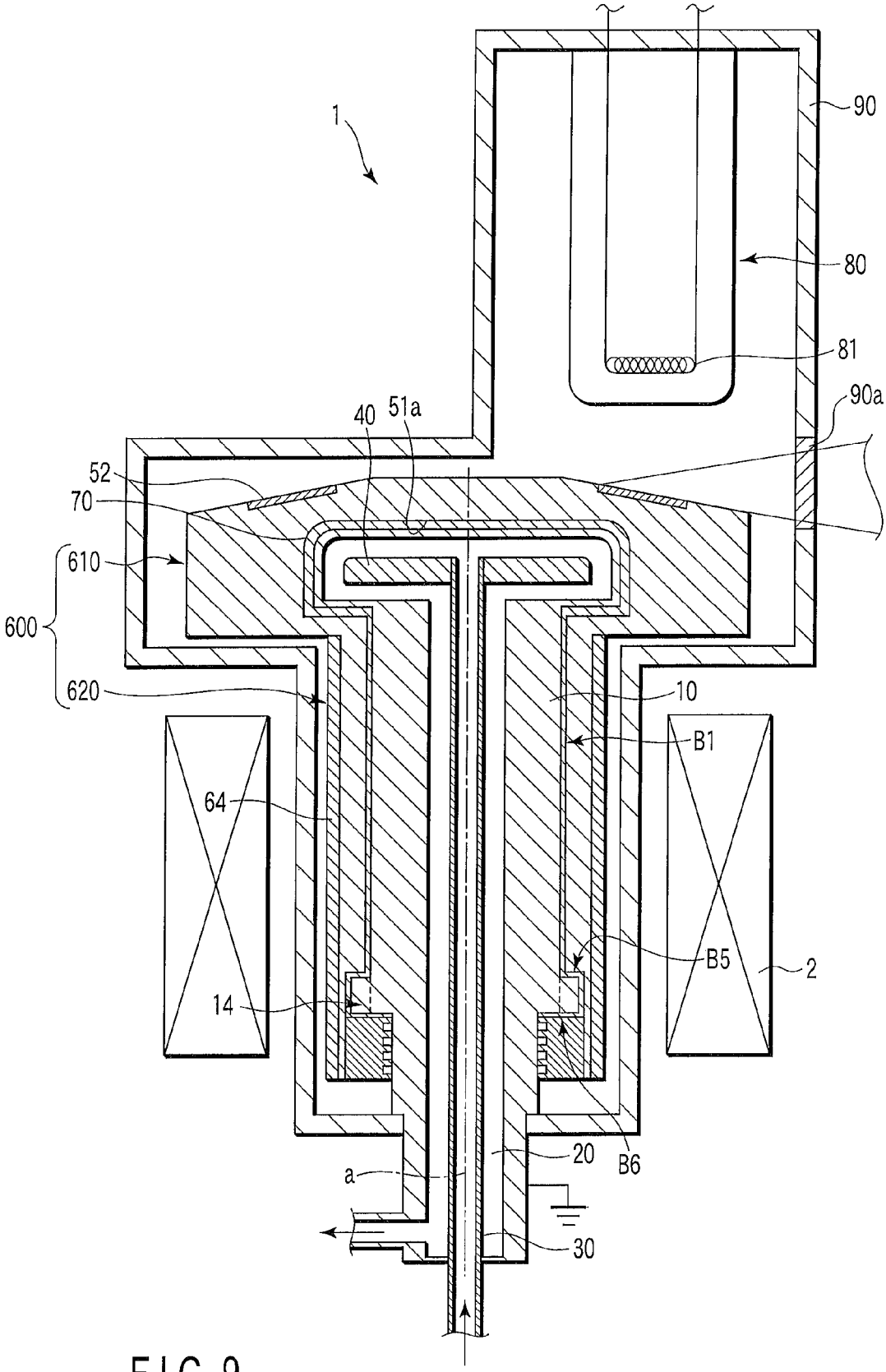
FIG. 9 is a sectional view showing a rotating anode X-ray tube assembly according to a fifth embodiment of this invention.

As shown in FIG. 9, a fixed shaft 10 further includes an annular portion 14. A barrel portion 61 includes a stepped portion 61*a*. The annular portion 14 is fitted in a space that is surrounded by the stepped portion 61*a* and a seal portion 63. A rotating anode X-ray tube 1 forms thrust bearings B5 and B6.

In a direction along a rotation axis a, a recess 51*a* overlaps only a part of a target layer 52, or more specifically, a region inside the target layer 52. Thus, a heat transfer channel of a liquid metal 70 is disposed only just under (or inside) the region inside the target layer 52. The inside diameter of a large-diameter portion 610 (diameter of the recess 51*a*) is smaller than that of the large-diameter portion 610 of the foregoing fifth embodiment (diameter of the recess 51*a*).

According to the rotating anode X-ray tube assembly constructed in this manner, an anode target 50 includes the recess 51*a* that overlaps the target layer 52, and the fixed shaft 10 is fitted in the recess 51*a*. The target layer 52 and a channel for the coolant 20 are situated close to each other. Thus, a heat conduction path from the target layer 52 to the channel for the coolant 20 is short.

Since the heat transfer channel of the liquid metal 70 is disposed just under (or inside) a part of the target layer 52, the cooling efficiency of the anode target 50 can be made higher than in the case where the heat transfer channel of the liquid metal 70 is not provided.

Since the inside diameter of the large-diameter portion 610 is small, generation of heat by a shearing stress of the liquid metal 70 can be suppressed.

The following is a description of an adverse effect of heat generated by the shearing stress of the liquid metal 70 on the rotating anode X-ray tube assembly. The larger the inside diameter of the large-diameter portion 610, the higher the intensity of heat generated by the shearing stress of the liquid metal 70 is. If the heat generated by the liquid metal 70 becomes higher, a rotational torque for rotating the rotor 600 at a necessary rotational frequency also becomes higher. Inevitably, therefore, a stator coil 2 (motor) for rotating the rotor 600 needs to be made larger. Thus, the weight and size of the rotating anode X-ray tube assembly inevitably increases, so that it is difficult to mount the rotating anode X-ray tube assembly in a CT apparatus.

Accordingly, there can be obtained the rotating anode X-ray tube 1 of which the anode target 50 has a high enough cooling rate to prolong the product life and the rotating anode X-ray tube assembly provided with the rotating anode X-ray tube 1.

The following is a detailed description of a rotating anode X-ray tube device according to a sixth embodiment of this invention. Other configurations in this embodiment are the same as those in the first embodiment described above, so that like numbers are used to designate like portions, and a detailed description thereof is omitted.

Figure 10:
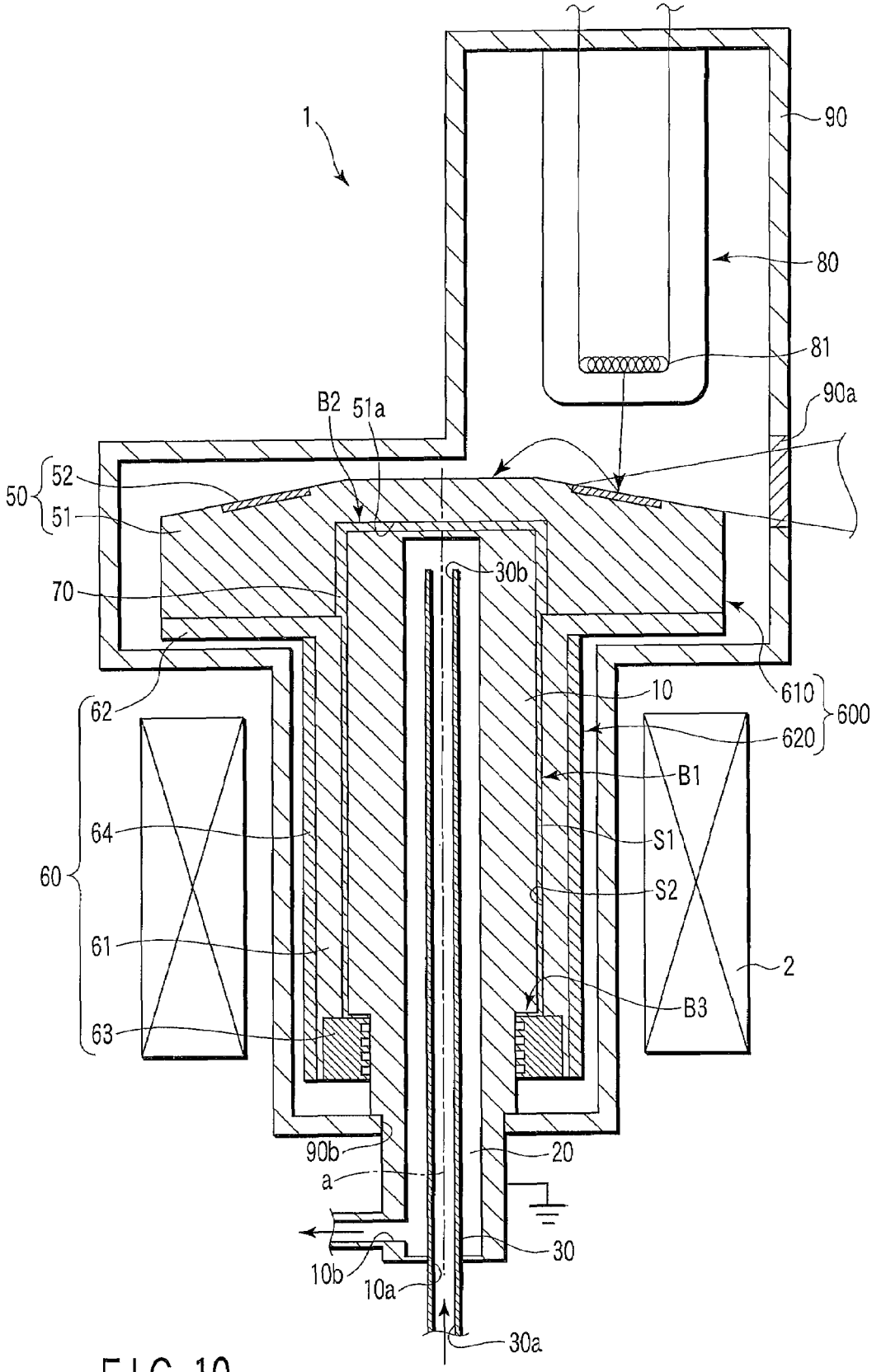
FIG. 10 is a sectional view showing a rotating anode X-ray tube assembly according to a sixth embodiment of this invention.

As shown in FIG. 10, a rotating anode X-ray tube 1 comprises a fixed shaft 10, coolant 20, pipe portion 30, anode target 50, rotating portion 60, liquid metal 70 as a lubricant, cathode 80, and vacuum envelope 90. A heat transfer channel of the liquid metal 70 is disposed outside a region just under (or inside) a target layer 52. The rotating anode X-ray tube 1 includes a radial sliding bearing B1, thrust bearing B2, and thrust bearing B3.

The liquid metal 70 fills a clearance between one end portion of the fixed shaft 10 and a recess 51*a* and a clearance between the fixed shaft 10 (bearing surface S1) and a barrel portion 61 (bearing surface S2). All these clearances are connected together.

The rotor 600 includes a large-diameter portion 610 and a small-diameter portion 620 that is smaller in diameter than the large-diameter portion 610. In this embodiment, the inside diameter of the large-diameter portion 610 (diameter of the recess 51*a*) and the inside diameter of the small-diameter portion 620 (inside diameter of the barrel portion 61) are substantially equal.

According to the rotating anode X-ray tube assembly constructed in this manner, the anode target 50 includes the recess 51*a* that overlaps the target layer 52, and the fixed shaft 10 is fitted in the recess 51*a*. The target layer 52 and a channel for the coolant 20 are situated close to each other. Thus, a heat conduction path from the target layer 52 to the channel for the coolant 20 is short.

The recess 51*a* is formed in an anode 51, and the heat transfer channel of the liquid metal 70 is disposed in the recess 51*a*. Therefore, the cooling efficiency of the anode target 50 can be made higher than in the case where the recess 51*a* is not formed in the anode 51.

Since the inside diameter of the large-diameter portion 610 is substantially equal to that of the small-diameter portion 620 and small, generation of heat by a shearing stress of the liquid metal 70 can be suppressed.

Accordingly, there can be obtained the rotating anode X-ray tube 1 of which the anode target 50 has a high enough cooling rate to prolong the product life and the rotating anode X-ray tube assembly provided with the rotating anode X-ray tube 1.

The following is a detailed description of a rotating anode X-ray tube device according to a seventh embodiment of this invention. Other configurations in this embodiment are the same as those in the first embodiment described above, so that like numbers are used to designate like portions, and a detailed description thereof is omitted.

Figure 11:
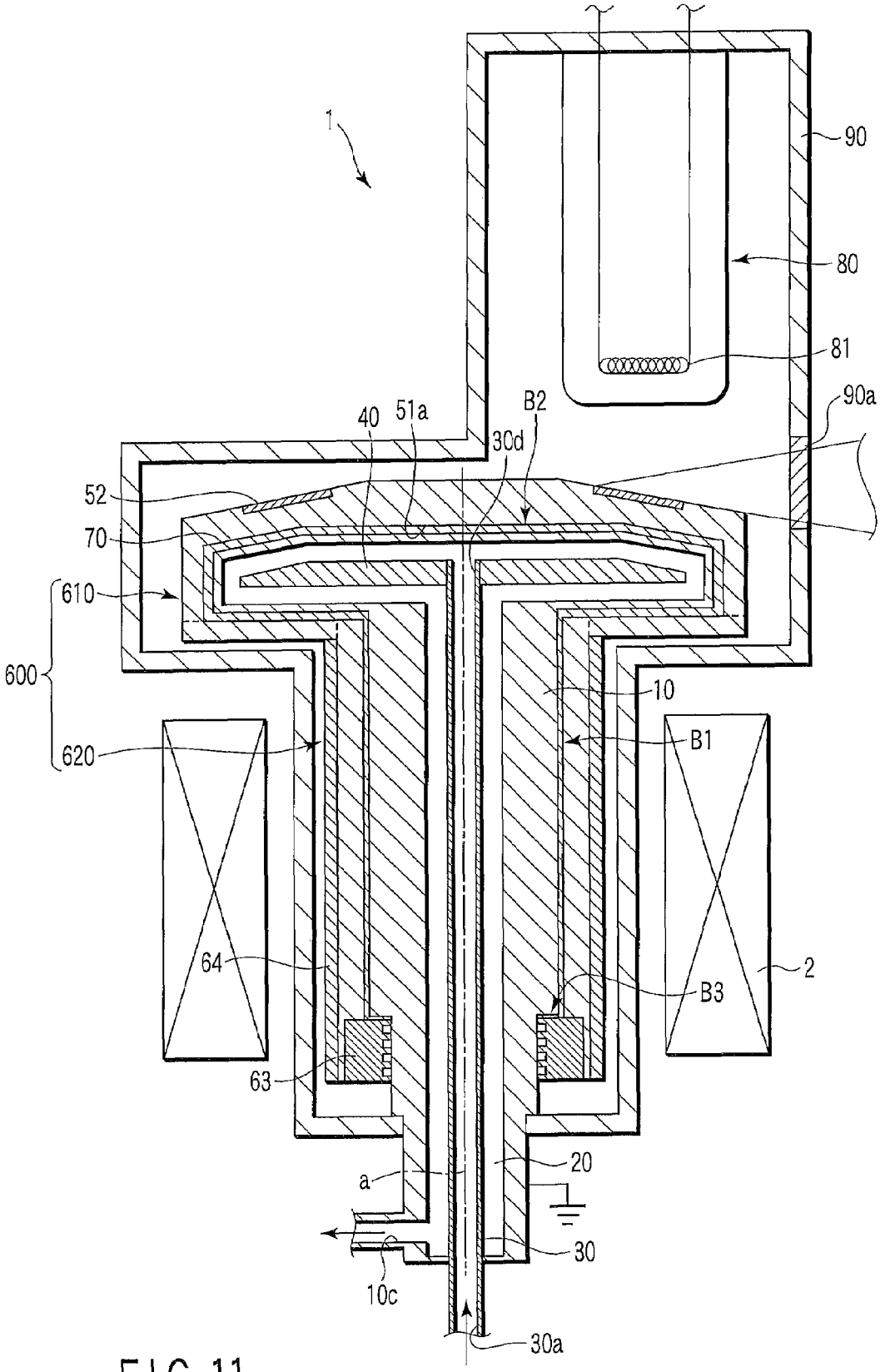
FIG. 11 is a sectional view showing a rotating anode X-ray tube assembly according to a seventh embodiment of this invention.

As shown in FIG. 11, the coolant 20 may be circulated reversely. A fixed shaft 10 has an intake port 10*c* on its other end side through which the coolant 20 is introduced. A pipe portion 30 has a discharge port 30*c* through which the coolant 20 is discharged and an intake port 30*d* through which the coolant 20 is introduced into the pipe portion 30. The discharge port 30*c* is situated outside the fixed shaft 10. The intake port 30*d* is situated at one end portion of the fixed shaft 10 in spaced relation.

Accordingly, the coolant 20 from outside a rotating anode X-ray tube 1 is introduced through the intake port 10*c* and discharged to the outside of the rotating anode X-ray tube 1 through a space between the fixed shaft 10 and a rotor 600, the interior of the pipe portion 30, and the discharge port 30*c*.

According to the rotating anode X-ray tube assembly constructed in this manner, an anode target 50 includes a recess 51*a* that overlaps a target layer 52, and the fixed shaft 10 is fitted in the recess 51*a*. The target layer 52 and a channel for the coolant 20 are situated close to each other. Thus, a heat conduction path from the target layer 52 to the channel for the coolant 20 is short.

The coolant 20 can be satisfactorily circulated even though the direction of circulation of the coolant 20 is reverse. The coolant 20 that is passed through the pipe portion 30 and heated is not given to the fixed shaft 10, but the coolant 20 is configured to be given directly to the fixed shaft 10. Thus, the fixed shaft 10 can be fully cooled, so that the rotor 600 can be rotated stably.

Accordingly, there can be obtained the rotating anode X-ray tube 1 of which the anode target 50 has a high enough cooling rate to prolong the product life and the rotating anode X-ray tube assembly provided with the rotating anode X-ray tube 1.

This invention is not limited directly to the embodiments described above, and in carrying out the invention, its components may be embodied in modified forms without departing from the spirit of the invention. Further, various inventions may be made by suitably combining a plurality of components described in connection with the foregoing embodiments. For example, some of the components according to the foregoing embodiments may be omitted. Furthermore, components according to different embodiments may be combined as required.

For example, the coolant 20 may be a mixed solution of water and an antifreeze solution. This coolant 20 may be used for boiling-cooling to reduce the temperature of the target layer 52. High cooling of the anode target 50 can also be performed in this case.

The thickness of the fixed shaft 10 may be any suitable value. The liquid metal 70 and a metal that contacts the liquid metal 70 produce a reaction product therebetween if the temperatures of their respective contact surfaces increase. The reaction product fills a clearance between the rotor 60 and the fixed shaft 10 and constitutes a resistance to the rotation of the rotor 60, thereby damaging the function of the rotor. Thus, the temperatures of the respective contact surfaces of the liquid metal 70 and the metal in contact with it must be reduced to some degree.

If the fixed shaft 10 is too thick, a temperature difference in the thickness direction of the fixed shaft 10 inevitably increases. In consequence, the temperatures of the liquid metal 70 and a heating surface of the fixed shaft 10 increase and may possibly produce a reaction product.

Thus, the temperature of the heating surface can be lowered by reducing the thickness of the fixed shaft 10 to a certain degree. Preferably, the thickness of the fixed shaft 10 ranges from 0.05 to 5 mm, whereby the function of the rotor can be maintained for a long period of time.

The fixed shaft 10 should at least be formed of a material such as low-carbon steel, molybdenum, or a molybdenum alloy, and the surface of the fixed shaft 10 should only be coated with a metal that reacts with the liquid metal 70 at high temperature. By thus preventing the production of the reaction product, the function of the rotor can be maintained for a long period of time. The surface of the fixed shaft 10 can be coated by simply using means such as metal plating or thermal spraying.

Further, the surface of the fixed shaft 10 may be coated with an inorganic material such as a ceramic material. By thus preventing the production of the reaction product, the function of the rotor can be maintained for a long period of time.

The fixed shaft 10 may be formed of low-carbon steel, and the surface of the fixed shaft 10 may be coated with molybdenum. The surface may be coated with molybdenum by, for example, thermal spraying. Low-carbon steel has an advantage that it is highly strong and can be easily joined to another metal. Molybdenum is relatively slow in reacting with the liquid metal 70. Thus, the function of the rotor can be maintained for a long period of time.

As described above, the anode target 50 can be stably rotated for a long time to prolong the product life by coating the surface of the fixed shaft 10 with a material that does not react with the liquid metal 70 or forming the fixed shaft 10 itself from a material that does not react with the liquid metal 70.

According to this invention, there can be provided a rotating anode X-ray tube of which an anode target has a high enough cooling rate to prolong the product life.

What is claimed is:

1. A rotating anode X-ray tube comprising:

a fixed body having a radial sliding bearing surface on a side surface thereof and a channel therein through which a coolant flows;

a rotor including a discoid large-diameter portion, which has a recess fitted with one end portion of the fixed body with a clearance therebetween and constitutes an anode target, and a small-diameter portion, which surrounds the side surface of the fixed body, has on an inner surface thereof a radial sliding bearing surface which faces the aforesaid radial sliding bearing surface with a clearance, and is united with the large-diameter portion at one end portion thereof;

a lubricant filling the clearances;

a cathode arranged opposite to the anode target of the large-diameter portion; and a vacuum envelope which contains the fixed body, the rotor, the lubricant and the cathode, and fixes the fixed body at another end portion of the fixed body situated opposite the one end portion of the fixed body fitted in the recess.

2. A rotating anode X-ray tube according to claim 1, wherein the rotor includes a seal portion which is situated on the opposite side of the radial sliding bearing surface of the small-diameter portion from the large-diameter portion, maintains a rotation of the rotor, and suppresses a leakage of the lubricant.

3. A rotating anode X-ray tube according to claim 2, wherein the seal portion is formed to be annular and disposed covering the entire circumference of the side surface of the fixed body with a clearance.

4. A rotating anode X-ray tube according to claim 1, which further comprises a pipe portion which is disposed inside the fixed body and defines the channel in conjunction with the fixed body.

5. A rotating anode X-ray tube according to claim 4, which further comprises an annular portion disposed inside the large-diameter portion and formed integrally with the pipe portion so as to surround a side surface of the pipe portion.

6. A rotating anode X-ray tube according to claim 1, wherein the coolant is water.

7. A rotating anode X-ray tube according to claim 1, wherein the coolant is a mixed solution of water and an antifreeze solution.

8. A rotating anode X-ray tube according to claim 1, wherein the lubricant is a liquid metal.

9. A rotating anode X-ray tube according to claim 1, wherein the thickness of the fixed body ranges from 0.05 to 5 mm.

10. A rotating anode X-ray tube according to claim 1, wherein the fixed body is formed of steel, molybdenum, or a molybdenum alloy as a material, and the surface of the fixed body is coated with a metal which reacts with the liquid metal at high temperature.

11. A rotating anode X-ray tube according to claim 10, wherein the surface of the fixed body is coated with an inorganic material.

12. A rotating anode X-ray tube according to claim 11, wherein the surface of the fixed body is coated with a ceramic material.

13. A rotating anode X-ray tube according to claim 1, wherein the fixed body is formed of steel, and the surface of the fixed body is coated with molybdenum.

* * * * *